US006343595B1

(12) United States Patent
Nakabayashi et al.

(10) Patent No.: US 6,343,595 B1
(45) Date of Patent: Feb. 5, 2002

(54) IGNITION COIL FOR INTERNAL COMBUSTION ENGINE

(75) Inventors: Kenji Nakabayashi, Hitachinaka; Junichi Shimada; Noboru Sugiura, both of Mito, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/499,627

(22) Filed: Feb. 8, 2000

(30) Foreign Application Priority Data

Feb. 8, 1999 (JP) ..... 11-030163

(51) Int. Cl.[7] ..... H01F 27/32; H01F 38/12
(52) U.S. Cl. ..... 123/634; 336/96; 336/205
(58) Field of Search ..... 123/634; 336/96, 336/205

(56) References Cited

U.S. PATENT DOCUMENTS 5,361,057 A 11/1994 Ito et al. ..... 336/198
6,208,231 B1 3/2001 Oosuka et al. ..... 123/634

FOREIGN PATENT DOCUMENTS

JP 08 093616 A 4/1996
JP 08 097057 A 4/1996
JP 08 144916 A 6/1996
JP 08 203757 A 8/1996
JP 08 255719 A 10/1996
JP 09 007860 A 1/1997
JP 09 017662 A 1/1997
JP 10-112413 A 4/1998 ..... H01F/27/32
JP A-11-111545 4/1999

*Primary Examiner*—Andrew M. Dolinar
(74) *Attorney, Agent, or Firm*—Crowell & Moring LLP

(57) ABSTRACT

In an independent ignition type ignition coil for an internal combustion engine which is used being directly coupled to a corresponding ignition plug, a center core 1, a secondary coil 3 wound around a secondary coil bobbin 2 and a primary coil 5 wound around a primary coil bobbin 4 are arranged concentrically in a coil casing 6 in this order from the inside thereof and such as epoxy resin 8 and soft epoxy 17 are filled between these constituting members, wherein on the outer surface of the primary coil 5 a cover film which promotes peeling off thereof from the epoxy resin 8 is formed, and because of existence of these peeling off portions between the primary coil 5 and the epoxy resin 8 and between the layers of the primary coil 5, a stress component induced inside the secondary coil bobbin 2 due to heat contraction difference between the primary coil 5 and the secondary coil bobbin 2 among thermal stress induced inside the secondary coil bobbin 2 is reduced.

26 Claims, 13 Drawing Sheets

1 ··· CENTER CORE, 2 ··· SECONDARY COIL BOBBIN,
3 ··· SECONDARY COIL, 4 ··· PRIMARY COIL BOBBIN,
5 ··· PRIMARY COIL, 6 ··· COIL CASING,
7 ··· SIDE CORE, 8 ··· EPOXY RESIN, 17 ··· SOFT EPOXY RESIN.

1 ··· CENTER CORE, 2 ··· SECONDARY COIL BOBBIN,
3 ··· SECONDARY COIL, 4 ··· PRIMARY COIL BOBBIN,
5 ··· PRIMARY COIL, 6 ··· COIL CASING,
7 ··· SIDE CORE, 8 ··· EPOXY RESIN, 17 ··· SOFT EPOXY RESIN.

IGNITION COIL FOR INTERNAL COMBUSTION ENGINE

BACKGROUND OF THE INVENTION

The present invention relates to an independent ignition type ignition coil for an internal combustion engine which is mounted for each of respective ignition plugs for the internal combustion engine and is directly coupled each of the respective ignition plugs.

These days an independent ignition type ignition coil device for an internal engine has been developed which is used after being mounted in each of plug holes in the engine and being directly coupled to each of the respective ignition plugs. The ignition coil device of this sort unnecessitates a distributor, as a result, the decreasing of supply energy to an ignition coil through the distributor, high voltage codes therefor and the like is eliminated, moreover, since the ignition coil can be designed without taking into account of the ignition energy decreasing, it is evaluated that the voltage for the ignition coil can be reduced and the size reduction of the ignition coil is achieved as well as because of the elimination of the distributor the spacing for mounting a variety of parts in an engine room is rationalized.

The ignition coil of such independent ignition type is called as an in-plug mounting type, since at least a part of the coil portion is introduced into a plug hole and is mounted or fitted there, further, the coil portion is commonly called as a pencil coil, since the coil portion is shaped into a long and slender pencil so as to permit insertion the same into the plug hole, and inside a long and slender cylindrical casing a center core (which is an iron core made magnetic flux passage and is formed by laminating many silicon steel sheets), a primary coil and secondary coil are disposed. Through conduction and interruption control of a current flowing through the primary coil a high voltage necessary for ignition is generated in the secondary coil, therefore, these coils are usually wound around respective bobbins and are disposed concentrically around the center core. The insulation property for the coils is guaranteed such as by filling (hardening after filling) an insulation use resin and by sealing an insulation oil into the coil casing accommodating the primary and secondary coils. For example, JP-A-8-255719, JP-A-9-7860, JP-A-9-17662, JP-A-8-93616, JP-A-8-97057, JP-A-8-144916, and JP-A-8-203757 disclose prior art of the present invention.

There are two types of pencil coils, in one the primary coil is disposed inside and the secondary coil is disposed outside, and in the other the secondary coil is disposed inside and the primary coil is disposed outside. Among these two, the entire wire length of the secondary coil in the latter type (inner secondary coil structure) is short in comparison with that in the former type (outer secondary coil type) and the electrostatic stray capacity at the secondary side thereof is also small, therefore, the inner secondary coil structure is understood advantageous with regard to its output characteristic.

Namely, the secondary output voltage and its building up characteristic are affected by the electrostatic stray capacity and when the electrostatic stray capacity increases, the output voltage reduces and the building up thereof is caused to delay. Accordingly, it is considered that the inner secondary coil structure which has a small electrostatic stray capacity is suitable for reducing the size thereof and for raising the output voltage.

SUMMARY OF THE INVENTION

Among these sorts of the ignition coil devices of the independent ignition type, a type which uses the insulation use resin (for example, epoxy resin) filled between the constituting members (between such as a center core, bobbins and coils and between such as layers of the coils) in the coil casing eliminates a measure for sealing which is necessitated such as in the insulation oil sealing type, further, the constituting members thereof such as the center core, the bobbins and the coils are by themselves secured only by burying the same into the insulation use resin, therefore the measure for securing the constituting members is simplified in comparison with the insulation oil sealing type and thus it is evaluated that a simplification of the total device and handling easiness thereof are achieved.

Since as the insulation use resin between the constituting members of the ignition coil device an epoxy resin is injected and hardened (filled), and since the hardening temperature of such epoxy resin is usually more than 100° C., under a low temperature less than the hardening temperature such as the insulation use resin the bobbin material are subjected to a thermal stress based on linear expansion coefficient differences between the constituting members (in that linear thermal expansion differences between such as the bobbins, coils, center core and the insulation use resin), therefore, it is necessary to take some measures for preventing possible crackings and interface peeling-offs between the members due to the thermal stress.

For example, in case of the inner secondary coil structure type;

(1) First of all, it is an important point how to reduce a thermal stress between the center core and the secondary coil bobbin of which linear expansion coefficient difference is large. For this purpose the following measures, for example, are taken, in that as the insulation use resin to be filled between the center core and the secondary coil bobbin such as a soft epoxy resin having a soft property at least above a normal temperature (a flexible epoxy resin; elastomer) is used in place of a hard epoxy resin so as to absorb a thermal impact, and in that after inserting a center core covered in advance by an insulation member having an elasticity into the secondary coil bobbin, the entire structure is sealed by a hard epoxy resin to ensure insulation property thereof.

(2) A primary factor of causing cracks in the bobbin material is understood to be an internal stress (thermal stress) of the bobbins due to linear expansion coefficient differences between the center core, the primary coil, the secondary coil and the bobbins (resin), in particular in case of the inner secondary coil structure type, it was clarified by the present inventors through a heat cycle testing (a heat cycle test of 130° C.~−40° C.) that the cracking (of which cracking is so called longitudinal cracking developing into the axial direction of the bobbin) is most likely caused in the secondary coil bobbin among both bobbin materials (the heat cycle test of 130° C.~−40° C. assumes a severe engine use environment condition in cold districts).

This crack generation mechanism in the secondary coil bobbin is caused, because the linear expansion coefficient of the bobbin material is large in comparison with those of the center core and the coil material. Namely, when the ignition coils are subjected to thermal contraction due to temperature drop after stopping of the engine operation, a thermal contraction of the secondary coil bobbin, in particular the degree of the thermal contraction in its circumferential direction is much larger than those of the center core and the coil materials (the primary coil and the secondary coil). Accordingly, when the secondary coil bobbin tends to undergo a thermal contraction, at the inside thereof the center core is subjected to the thermal contraction force (when the resin interposed between the secondary coil bobbin and the center core is an elastomer such as a soft epoxy resin, the center core is subjected to the thermal contraction force of the secondary coil bobbin at a temperature less than the glass transition temperature thereof), as a result, the secondary coil bobbin is applied relatively of a force from the side of the center core in relation to the center core and is subjected to an expansion force in the circumferential direction. Further, when the secondary coil bobbin tends to undergo a thermal contraction, the primary coil and the secondary coil of which linear expansion coefficients are smaller than that of the secondary coil bobbin act so as to suppress the thermal contraction of the secondary coil bobbin via the insulation use resin (in other words, a tension force in the circumferential direction is provided to the secondary coil bobbin). Due to these multiple actions a large internal stress (thermal stress) a is generated in the secondary coil bobbin and causes longitudinal direction crackings in the secondary coil bobbin.

Such longitudinal direction cracking in the secondary coil bobbin causes an electric field concentration between the center core and the secondary coil and finally leads to an insulation breakdown.

An object of the present invention is to improve an independent ignition type ignition coil which is mounted in a plug hole and is subjected to a severe temperature environment, in that to prevent the above mentioned crackings in the secondary coil bobbin, to hold a soundness of an electric insulation performance thereof, and to achieve a high quality and high reliability of the concerned type ignition coil device.

The present invention primarily proposes the following task resolving measures for achieving the above object.

(1) Namely, an independent ignition type ignition coil for an internal combustion engine according to a first aspect of the present invention which is used after being inserted into a plug hole in the internal combustion engine and being directly coupled to a corresponding ignition plug, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, is characterized in that between the primary coil bobbin and the primary coil and/or between layers of the primary coil a gap portion which reduces a stress component caused inside the secondary coil bobbin due to thermal contraction difference of the primary coil and the secondary coil bobbin among thermal stress caused inside the secondary coil bobbin is coexisted with the insulation use resin.

The gap is obtained by forming a peeling off portion at least one, between the primary coil bobbin and the insulation use resin (for example, an epoxy resin) filled between the primary coil bobbin and the primary coil, between the insulation use resin filled between the primary coil bobbin and the primary coil and the primary coil and between the primary coil and the insulation use resin filled between the layers of the primary coil.

More specifically, the present invention proposes such as to apply on the primary coil a cover film or a cover coating which facilitates peeling off of the primary coil from the insulation use resin filled around the primary coil, to apply on a side of bobbin surfaces (the outside surface of the bobbin) of the primary coil bobbin on which the primary coil is wound a cover film or a cover coating which facilitates peeling off of the insulation use resin contacting the bobbin surface from the bobbin surface, and in place of these cover film and cover coating to adhere an insulation sheet having a weak adhesiveness to an epoxy resin on the primary coil. As a material for the cover film or the cover coating material having a slipping property, such as nylon, polyethylene and teflon and an overcoating containing in an insulation material a material having a small adhesiveness to an epoxy resin are exemplified.

When temperature lowers after hardening the epoxy resin a tension force acts at the interfaces between the epoxy resin and the primary coil or the primary coil bobbin due to the linear expansion coefficient difference between the epoxy resin and the primary coil material copper, and a peeling off will be caused at a portion having a weak adhesiveness with the epoxy resin.

The principle of the present invention is as follows, in that when the ignition coil tends to undergo a thermal contraction due to temperature drop after stopping of the engine operation, the secondary coil bobbin is subjected relatively to an expansion force in the circumferential direction from the side of the center core due to the thermal contraction difference (the linear expansion coefficient difference), further, the secondary coil bobbin is subjected relatively to a tension force in the circumferential direction from the side of the primary coil and the secondary coil via the insulation use resin and with these multiple actions a large internal stress $\sigma$ is generated in the secondary coil bobbin. However, according to the present invention, a gap (for example, the above peeling off portion) is interposed between the primary coil bobbin and the primary coil and/or between the layers of the primary coil, thereby, a transmission passage of the tension force in the circumferential direction acting from the primary coil to the secondary coil bobbin can be interrupted.

Accordingly, among the stress $\sigma 1$ caused in the secondary coil bobbin a stress component $\sigma 1$ caused in the secondary coil bobbin due to the thermal contraction difference between the primary coil and the secondary coil bobbin is reduced, thereby, the total internal stress $\sigma$ can be greatly reduced (relaxed). According to CAE (Computer Aided Engineering) analysis examples performed by the present inventors, through the reduction of the above mentioned stress component $\sigma 1$ it is determined that at least 20% of the total internal stress can be reduced. Further, such reduction value in the internal stress was confirmed by making use of an ignition coil which is used after being inserted into a plug hole in an internal combustion engine and being directly coupled to a corresponding ignition plug and of which portion being inserted into the plug hole has an outer diameter of 18 mm~27 mm (in a long and slender cylindrical type ignition coil of this sized, usually the thickness of the primary coil bobbin is 0.5 mm~1.2 mm, the thickness of the secondary coil bobbin is 0.7 mm~1.6 mm and the length of the bobbins is 0.5 mm~150 mm).

Further, it was confirmed through experimental results that even if the above mentioned gap (for example the peeling off portion) is provided between the primary coil bobbin and the primary coil and/or between the layers of the primary coil, no electric field concentration between the primary coil is caused because of a low potential (substantially at the ground potential) of the primary coil, in addition if the secondary coil, the insulation use resin and the primary coil bobbin are closely bonded without gaps, the insulation between the primary coil and the secondary coil can be sufficiently ensured, moreover, a possible electric field concentration due to the line voltage of the secondary coil can be sufficiently prevented, thereby a possible generation of insulation breakdown can be prevented. (2) Further, in addition to the above explained first aspect of the present invention, for example, when a denaturated PPE (denaturated polyphenylene-ether) is used for the secondary coil bobbin, and if in view of material property improvement of the secondary coil bobbin, more than 20 weight % of inorganic filler material is included in the secondary coil bobbin, the internal stress a therein can be further reduced.

Although the denaturated PPE is excellent in its adhesiveness with the epoxy resin serving as the insulation use resin, and further the moldability and insulation property thereof are desirable which contribute to stabilize the quality of the secondary coil bobbin, however, if it contains an inorganic filler material of less than 20 weight %, the linear expansion coefficient difference with other constituting members (such as the center core, the primary coil and the secondary coil) enlarges and the internal stress (thermal stress) σ increases. For example, according to CAE analysis examples performed, when there is no decreases in the above mentioned σ, and when the temperature of the ignition coil is suddenly reduced under a temperature environment of 130° C.~−40° C., the internal stress a generated in the secondary coil bobbin showed a large value of about 90 MPa~100 MPa. Contrary thereto, according to the present invention the internal stress a can be reduced below 70 MPa, thereby, the longitudinal direction cracking in the secondary coil bobbin can be prevented. Further, as an optimum example which can reduce the internal stress σ while maintaining the moldability (resin flowability), the present invention proposes a material constituted by 45 weight % ~60 weight % of denaturated PPE, 15 weight % ~25 weight % of glass fiber and 15 weight % ~35 weight % of inorganic filler material in a non-fiber shape, the details of which will be explained in the description of the embodiments below.

Further, in view of the fact that it is preferable to vary linear expansion coefficient of a bobbin concerned for reducing the internal stress σ in the bobbin, when the resin flowing direction for the resin molding is the bobbin axial direction, a desirable result was obtained when the linear expansion coefficient in orthogonal direction, (which corresponds to the radial direction and the circumferential direction of the bobbin, and an important point for preventing the longitudinal direction cracking of the bobbin is in particular, to suppress the internal stress in the circumferential direction) with respect to the resin flowing direction is $35\sim75\times10^{-6}$ in average at a temperature range −30° C. ~−10° C. based on a testing method conformed to ASTM D696 in the above referred to limited containing range of the inorganic filler material, of which details will also be explained in the description of the embodiments below.

DETAILED DESCRIPTION OF THE PREFERRED EMBODIMENT

Embodiments of the present invention will be explained with reference to the drawings.

Figure 1:
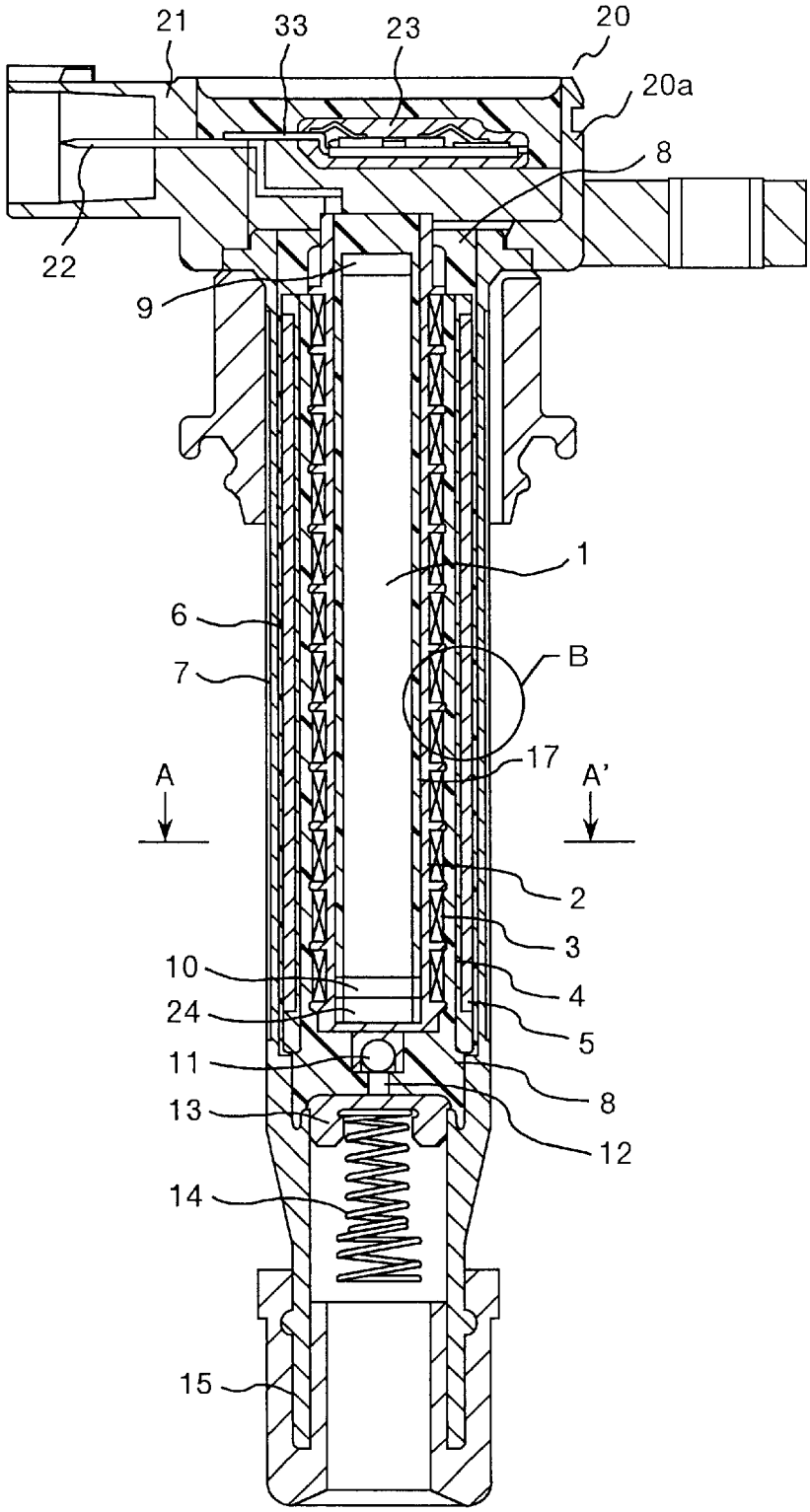
FIG. 1 is a vertical cross sectional view of an ignition coil for an internal combustion engine representing one embodiment of the present invention.
Figure 2:
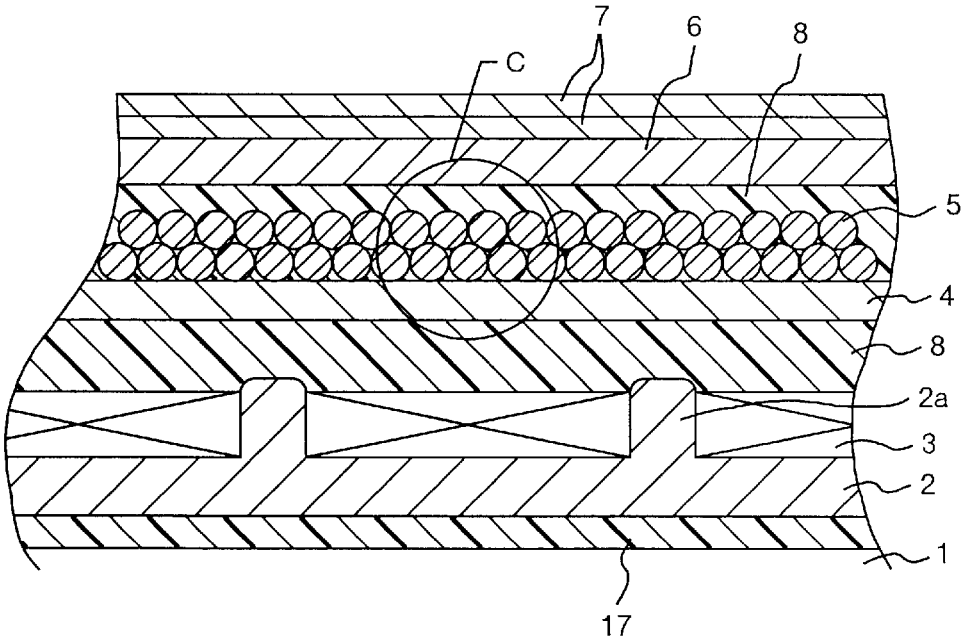
FIG. 2 is an enlarged view showing by enlarging and turning in lateral direction of portion B in FIG. 1.
Figure 3:
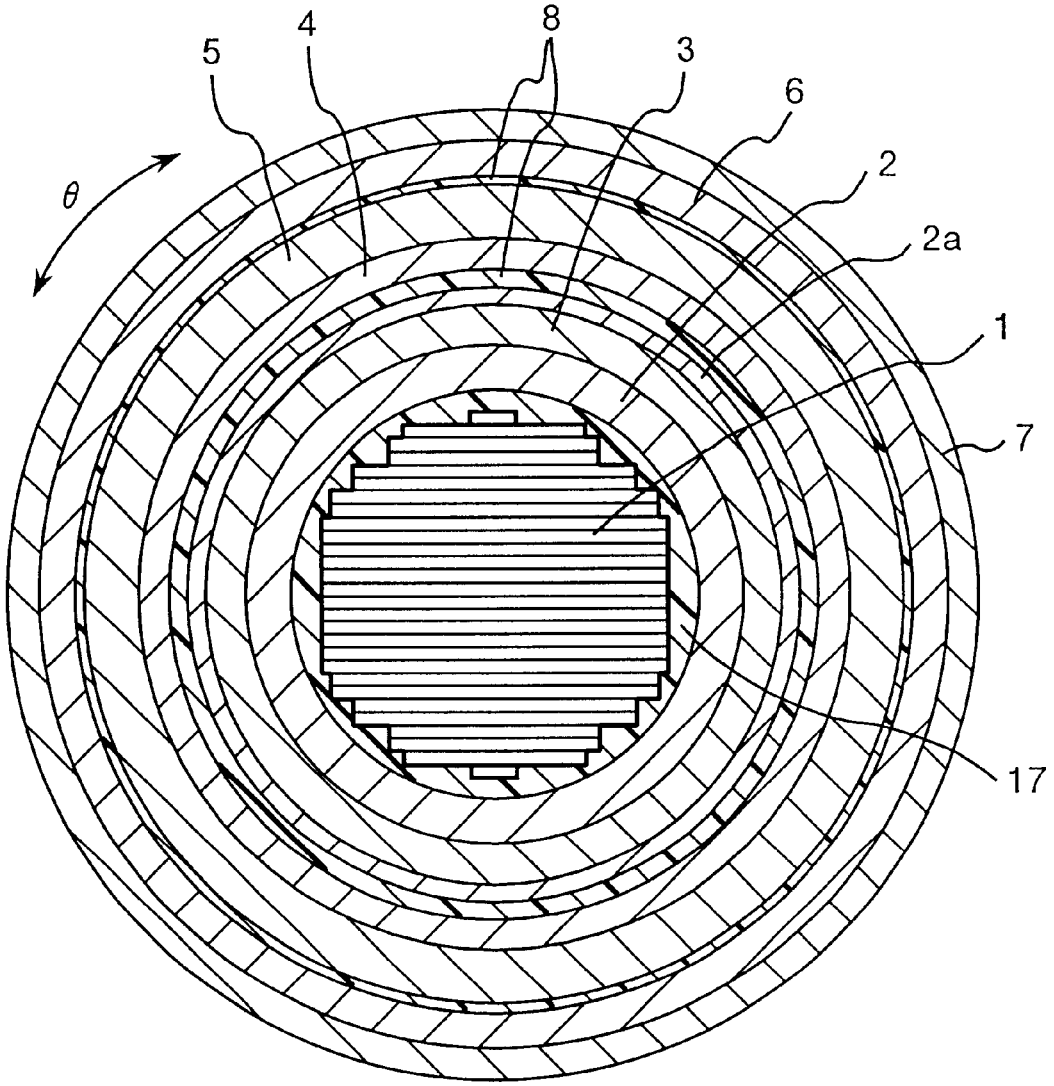
FIG. 3 is a lateral cross sectional view taken along a line A–A' in FIG. 1.

FIG. 1 is a vertical cross sectional view of an ignition coil for an internal combustion engine representing one embodiment of the present invention, FIG. 2 is a view showing by enlarging portion B in FIG. 1 and by turning the same in lateral direction, and FIG. 3 is a lateral cross sectional view taken along a line A–A' in FIG. 1.

Inside a long and slender cylindrical casing (outer sheath casing) 6 a center core 1, a secondary coil wound around a secondary coil bobbin 2 and a primary coil 5 wound around a primary coil bobbin 4 are arranged concentrically from the center (inside) thereof toward the outside. At the outside of the outer sheath casing 6 a side core 7 which forms a magnetic flux passage with the center core 1 is mounted.

The center core 1 is formed by pressedly laminating many number of silicon steel sheets or directional silicon steel sheets having a few types of different width as for example illustrated in FIG. 3 for increasing the cross sectional area thereof. At both ends of the center core 1 in its axial direction magnets 9 and 10 are disposed adjacent to the center core 1. These magnets 9 and 10 generate magnetic fluxes in the direction opposite to coil induced magnetic fluxes passing through the center core 1, thereby, the core of the ignition coil can be operated below the saturation point in the magnetizing curve of the core. The magnet can be disposed only at one end of the center core 1. Reference numeral 24 is an elastic body (for example, a rubber) which absorbs a thermal expansion of the center core 1 in its axial direction.

Between the center core 1 which is inserted within the secondary coil bobbin 2 and the secondary coil bobbin 2 as illustrated in FIG. 2, a so called soft epoxy resin (a flexible epoxy) 17 is filled and in gaps between the respective constituting members of the secondary coil bobbin 2, the secondary coil 3, the primary coil bobbin 4, the primary coil 5 and the coil casing 6 a hard epoxy resin (a thermosetting epoxy resin) 8 is filled.

The soft epoxy resin 17, of which glass transition temperature is below a normal temperature (20° C.), is an epoxy resin having an elastic and soft property (elastomer) above the glass transition temperature and is, for example, a mixture of an epoxy resin and a denaturated aliphatic polyamide.

The reason why the soft epoxy resin 17 is used for the insulation use resin between the center core 1 and the secondary coil bobbin 2 is that since the so-called pencil type coil (an in-plug hole mounted independent ignition type ignition coil) is subjected to a severe temperature environment (a thermal stress of about −40° C.~130° C.) as well as the difference between the linear expansion coefficient ($13\times10^{-6}$) of the center core 1 and the linear expansion coefficient ($40\times10^{-6}$) of the hard epoxy resin is large, if a usual insulation use epoxy resin (an epoxy resin composition harder than the soft epoxy resin 17) is used, it is feared that a cracking will occur in the epoxy resin due to heat shock (thermal impact) and an insulation breakdown will be caused. Namely, so as to counter-measure such heat shock the soft epoxy resin 17 is used which is an elastic body excellent for absorbing a thermal impact and has an insulation property.

Now, the secondary coil bobbin 2 will be explained. The secondary coil bobbin 2 according to the present embodiment is provided based on the following knowledges.

(1) The secondary coil bobbin is required to satisfy the condition; [an allowable stress $\sigma$0 of the secondary coil bobbin 2> an induced stress $\sigma$ at temperature (−40° C. minus glass transition temperature Tg of the soft epoxy resin 17)]. Herein, as an example, a glass transition temperature Tg=−25° C. of the soft epoxy resin 17 is exemplified.

For example, when the glass transition temperature of the soft epoxy resin 17 is Tg=−25° C. and when the secondary coil bobbin 2 is placed under an environment in which temperature varies in a range of 130° C.~−40° C. and contracts because of a temperature drop after stopping of the operation of the concerned internal combustion engine, the contraction of the secondary coil bobbin 2 can be accepted in a temperature range of 130° C.~−25° C. through the elastic absorption by the soft epoxy resin 17, therefore, among the thermal stress a caused in the secondary coil bobbin 2 a thermal stress component $\sigma3$ acted from the side of the center core 1 is substantially null stress. However, when observing as a whole, if the secondary coil bobbin 2 tends to undergo a thermal contraction, the primary coil 5 and the secondary coil 3 of which linear expansion coefficients (thermal expansion coefficients) are smaller than that of the secondary coil bobbin 2 act to suppress the thermal contraction of the secondary coil bobbin 2 via the hard epoxy resin 8. In other words, the primary coil 5 and the secondary coil 3 provide relatively a tension force to the secondary coil bobbin 2 in the circumferential direction. Thereby, the sum of a thermal stress component $\sigma1$ acted from the primary coil 5 and a thermal stress component $\sigma2$ acted from the secondary coil 3 constitutes main components in the internal stress $\sigma$ in the secondary coil bobbin 2.

In a temperature range of −25° C.~−40° C., the soft epoxy resin 17 moves into a glass state, thereby, the contraction (deformation) from the side of the center core 1 of the secondary coil bobbin 2 is also prevented, thus at the inside of the secondary coil bobbin 2 in addition to the above mentioned thermal stresses $\sigma1$ and $\sigma2$ provided from the primary coil and the secondary coil, the thermal stress $\sigma$3 provided by a force from the side of the center core is added, and the summed stress of these components $\sigma1$, $\sigma2$ and $\sigma3$ constitutes the main components for the internal stress $\sigma$ in the secondary coil bobbin 2.

The thermal stress caused in the secondary coil. bobbin 2 can be expressed as $\sigma=E\cdot\epsilon=E\cdot\alpha\cdot T$. Wherein E is a Young's modulus of the secondary coil bobbin 2, $\epsilon$ is a stress therein, $\alpha$ is a linear expansion coefficient thereof and T is a temperature variatior (temperature difference). When the allowable stress $\sigma$0 for the secondary coil bobbin 2 is larger than the generated stress $\sigma(\sigma<\sigma_0)$, the secondary coil bobbin 2 is never broken.

(2) It is required to select a material which shows a good adhesiveness with the epoxy resin 8 for the secondary coil bobbin 2. When the adhesiveness of the selected material with the epoxy resin 8 is poor, it is feared that a peeling off between the secondary coil bobbin 2 and the epoxy resin 8 may be caused which will lead an insulation breakdown.

Now, a mechanism of such insulation breakdown, when a peeling off (including a cracking in the insulation use resin) between the insulation use resin and the bobbin material is caused, is explained with reference to FIG. 8.

Figure 8:
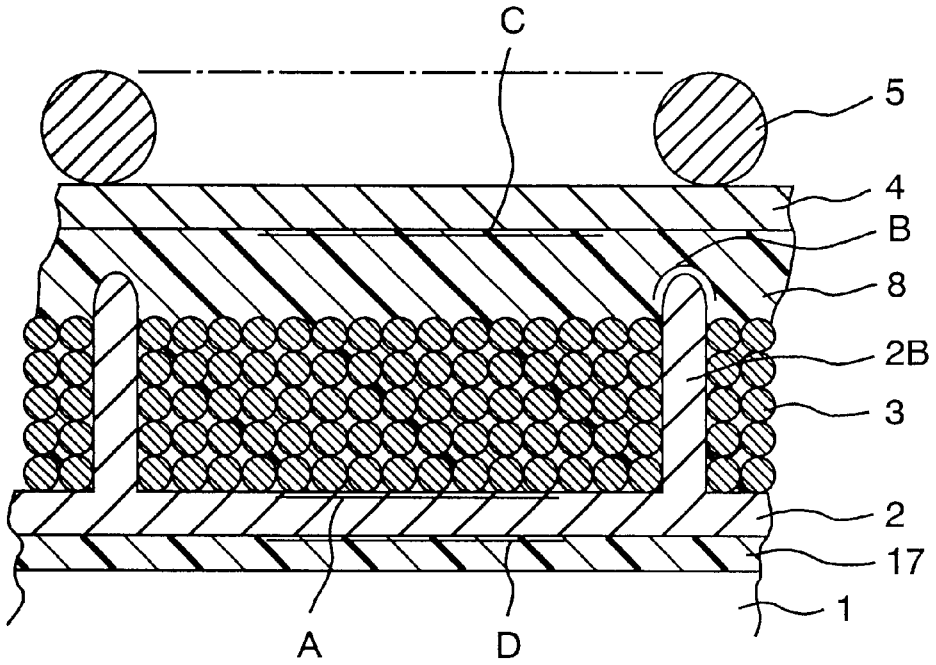
FIG. 8 is a model diagram showing manners of insulation breakdown when crackings are caused in respective parts in the ignition coil.

FIG. 8 shows a partly enlarged pencil coil having an inner secondary coil structure, in that partly enlarged cross sectional view showing a plurality of flanges (flanges for defining respective spool areas) 2B formed on the outer surface of the secondary coil bobbin 2 along the axial direction thereof with a predetermined interval so as to wind the secondary coil 3 in a divided manner.

Among the epoxy resins 8, the epoxy resin 8 which is filled between the secondary coil bobbin 2 and the primary coil bobbin 4 reaches to the outer surface of the secondary coil bobbin 2 through resin injection (vacuum injection) while penetrating between wires of the secondary coil 3 other than between the secondary coil 3 and the primary coil bobbin 4. Further, as has been already explained, between the center core 1 and the secondary coil bobbin 2 the soft epoxy resin 17 is filled.

In this instance, if an adherence strength (a bonding strength) between the insulation use resin, the secondary coil bobbin and the primary coil bobbin is poor, peelings-off are caused between the secondary coil bobbin 2 and the insulation use resin 8 penetrating between the secondary coil bobbin 2 and the secondary coil 3 as illustrated by reference character (a) and between the secondary coil bobbin flange 2B and the insulation use resin 8 as illustrated by reference character (b). Further, areas between the insulation use resin 8 and the primary coil bobbin 4 as illustrated by reference character (c) and between the insulation use resin 17 and the secondary coil bobbin 2 as illustrated by reference character (d) are also considered as possible areas where a peeling off can occur.

If a peeling off is caused at a position indicated by reference character (a), an electric field concentration is induced by the line voltage of the secondary coil 3 through the peeled off portion (a gap), which causes a partial discharge between the wires of the secondary coil 3 thereby to heat the same, and an enamel coating for the wire material of the secondary coil is burned off to cause a layer shorting. Further, if a peeling off is caused at a portion indicated by reference character (b), an electric field concentration between the wires between dividedly wound adjacent areas of the secondary coil 3 is caused and through a possibly induced partial discharge like the above a layer shorting is caused. If a peeling off is caused at the position indicated by reference character (c), an insulation breakdown will be caused between the secondary coil 3 and the primary coil 5, and if a peeling off is caused at the position indicated by reference character (d), an insulation breakdown will be caused between the secondary coil 3 and the center core 1.

In the present embodiment, in order to satisfy the above condition (2), a denaturated PPE which shows an excellent adhesiveness with an epoxy resin is used as the material for the secondary coil bobbin 2. In order to ensure the strength thereof, this material contains an inorganic material (such as glass filler and mica), further, in the present embodiment, in order to satisfy the above condition (1), namely, in order to lower the linear expansion coefficient $\alpha$ as much as possible, further in order to reduce the thermal stress (internal stress) $\sigma$ and resultantly in order to realize the above mentioned relationship, the allowable stress $\sigma\mathbf{0}>\sigma$, not less than 20 weight % of an inorganic material, preferably not less than 30 weight % thereof is mixed in the material mentioned above. Further, in order to ensure an injection moldability of the secondary coil bobbin 2, it is necessary to improve the flowability of the resin in its solution state, therefore, other than a fibrous material such as glass filler, mica representing non-fibrous inorganic material is mixed into the inorganic material.

Figure 10:
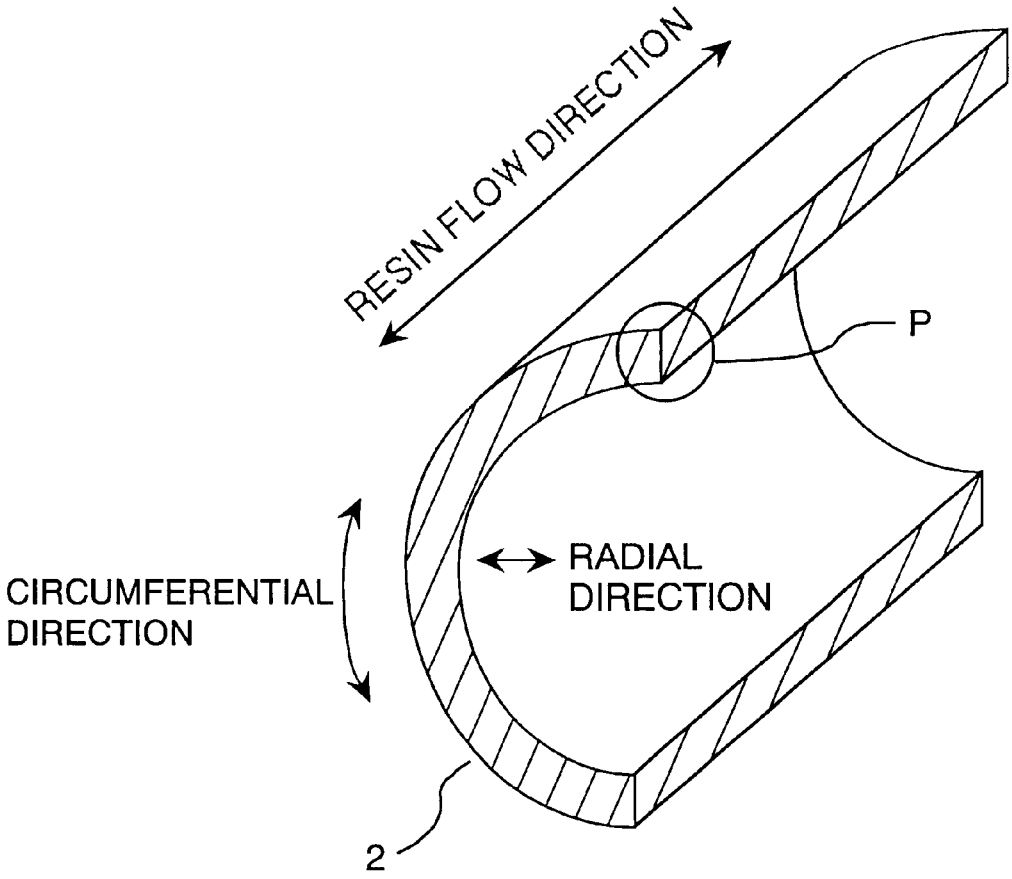
FIG. 10 a model diagram showing a part of the secondary coil bobbin used in the above embodiment while dividing the same in half and locally cross sectioning thereof.
Figure 11:
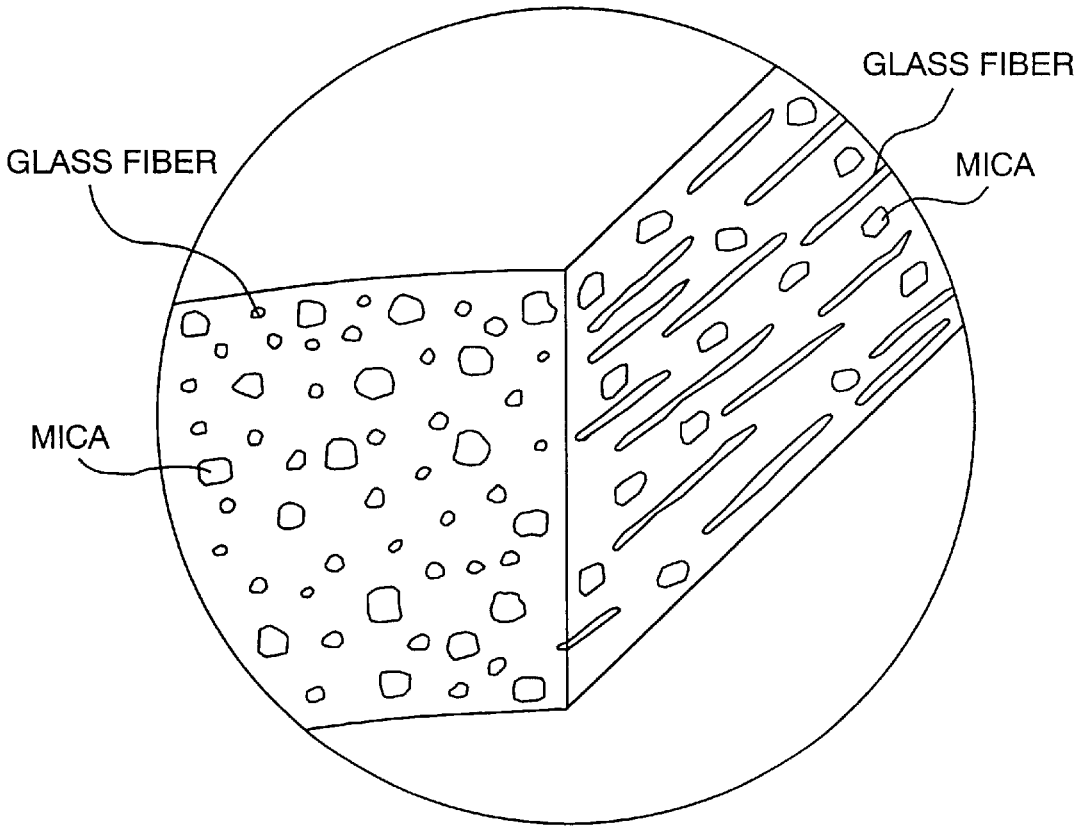
FIG. 11 is an enlarged view of portion P in FIG. 10.

FIG. 10 shows a perspective cross sectional view taken by cutting in half of a part of the secondary coil bobbin 2 according to the present embodiment, and the resin flow direction during molding of the secondary coil bobbin 2 of the present embodiment is in the axial direction of the bobbin, in that the radial direction and the circumferential direction of the bobbin is the orthogonal direction with respect to the resin flowing direction for the secondary coil bobbin 2. FIG. 11 is a view prepared by schematically enlarging portion P in FIG. 10, wherein the glass fibers serving as the filler is directed in the resin flowing direction, accordingly, the linear expansion coefficient of the secondary coil bobbin is sufficiently small in comparison with those in the radial direction and the circumferential direction which are orthogonal to the axial direction. When it is required to reduce the linear expansion coefficients in the radial direction and the circumferential direction without damaging the flowability of the resin, it is necessary to reduce the linear expansion coefficients in the radial direction and the circumferential direction as much as possible by mixing a non-fibrous filler material (for example, mica and talc) in addition to the glass fibers. It is necessary to reduce the linear expansion coefficient of the bobbin in the circumferential direction (orthogonal direction with respect to the resin flowing direction) as much as possible in order to endure the internal stress (thermal stress) a caused in the secondary coil bobbin 2.

Figure 13:
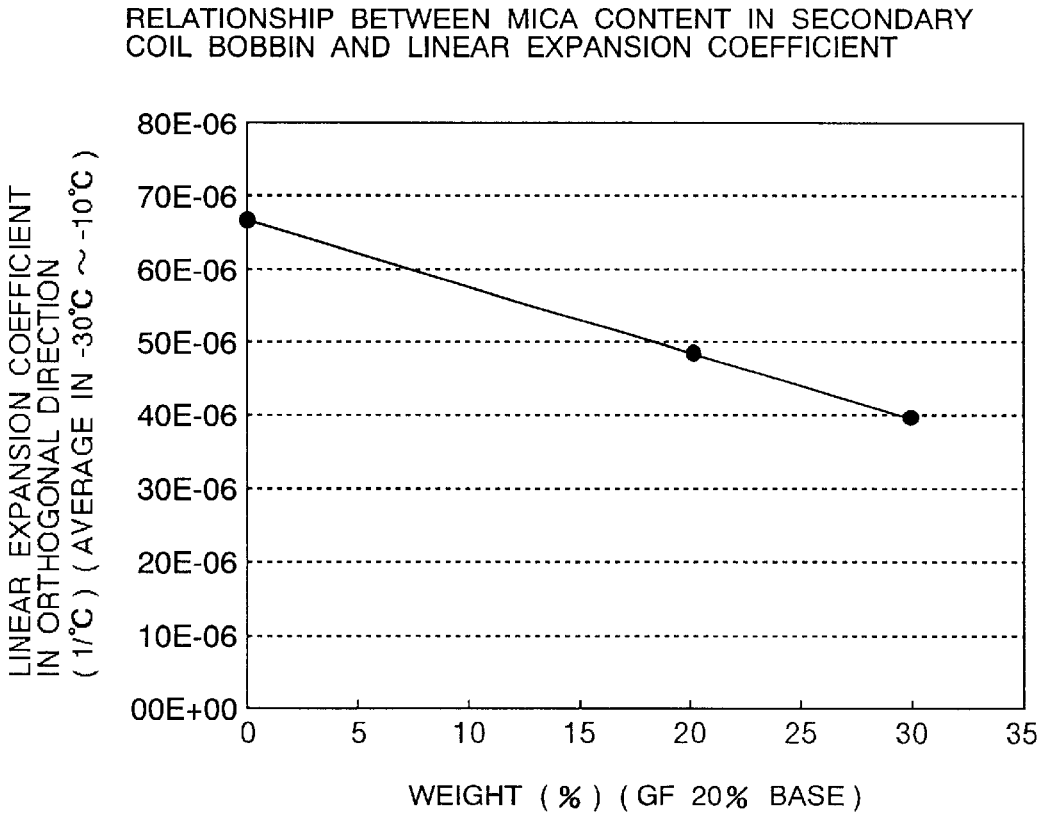
FIG. 13 is a diagram showing a relationship between mica content in the secondary coil bobbin and linear expansion coefficient.

FIG. 13 shows a relationship between amount of mica contained and linear expansion coefficient in orthogonal direction with respect to resin flowing direction (an average linear expansion coefficient in a temperature range of −30° C.~−10° C. determined according to a test method conformed to ASTM D696), when the secondary coil bobbin 2 is formed of a denaturated PPE (of 20 weight % glass fiber base). In the drawing E-06 represents $10^{-6}$. In this instance, when an amount of the inorganic filler is 20 weight % (20 weight % of glass fiber and 0 weight % of mica) in total, a linear expansion coefficient of above $70\times10^{-6}$ (in the test example, $66.8\times10^{-6}$) can be obtained, further, with 20 weight % of glass fiber and 20 weight % of mica a linear expansion coefficient of about $50\times10^{-6}$ (in the test example, $49.3\times10^{-6}$) is obtained and with 20 weight % of glass fiber and 30 weight % of mica a linear expansion coefficient of about $40\times10^{-6}$ (in the test example, $39.6\times10^{-6}$) is obtained. For example, when it is required to suppress the linear expansion coefficient at about $40\sim50\times10^{-6}$ and in case that the amount of the glass fiber is 20 weight %, the amount of mica is determined in a range of 20~30 weight %, further, when the amount of glass fiber is about 15~25 weight % and the linear expansion coefficient is required to be suppressed at about $40\cdot50\times10^{-6}$, the amount of mica of about 15~35 weight % is required. More specifically, the amount ranges of the respective constituting elements are 45~60 weight % of denaturated PPE, 15~25 weight % of glass fiber and 15~35 weight % of mica. An optimum composition example for the secondary coil bobbin 2 according to the present embodiment is 55 weight % of denaturated PPE, 20 weight % of glass fiber and 30 weight % of mica. As will be observed from FIG. 13, the linear expansion coefficient in the orthogonal direction is approximately inverse proportional to the mica content.

Further, a denaturated PPE containing 50 weight of inorganic material shows a linear expansion coefficient of $20\sim30\times10^{-6}$ in the resin flowing direction during molding thereof in a temperature range of −30° C.~100° C.

Now, it is of course advantageous to use a thicker bobbin in order to ensure the strength of the secondary coil bobbin 2, however, a pencil coil is generally required to be inserted into a slender plug hole having a diameter of 18 mm~27 mm, therefore, the outer diameter of the coil portion to be inserted including the side core has to be sized about 18 mm~27 mm. In such narrow space the constituting elements such as the coil casing 6, the primary coil 5, the primary coil bobbin 4, the secondary coil 3, the secondary coil bobbin 2 and the center core 1 have to be disposed and the epoxy resin 8 has to be filled in gaps between the constituting elements and in the constituting elements themselves so as to eliminate defects such as voids. Accordingly, it is desirable to reduce the thickness of the respective portions as much as possible.

In the present embodiment, the thickness of the primary coil bobbin is selected to be 0.5 mm~1.2 mm the thickness of the secondary coil bobbin is selected to be 0.7 mm~1.6 mm and the length of the bobbins is selected to be 50 mm~150 mm.

The linear expansion coefficient of the secondary coil 3 which is wound around the secondary coil bobbin 2 is about $20\times10^{-6}$ at a temperature of −40° C. under a condition that the epoxy resin 8 is impregnated between the wires thereof, and the linear expansion coefficient of the primary coil 4 which is wound around the primary coil bobbin 4 is about $22\times10^{-6}$ at a temperature of −40° C. under a condition that the epoxy resin 8 is impregnated between the wires thereof. Further, the linear expansion coefficients referred to throughout the present specification are determined according to a test method conforming to ASTM D696.

The secondary coil 3 is constituted by winding an enamel wire having a diameter of about 0.03 mm~0.1 mm in about 5000~35000 turns in total in a divided manner. On the other hand, the primary coil 5 is constituted by winding an enamel wire having a diameter of about 0.3 mm~1.0 mm in about 100~300 turns in total in a plurality of layers (herein two layers) while each layer containing a few ten turns. An outer cover structure of the primary coil 5 will be explained later.

The primary coil bobbin 4 is constituted by a PBT containing rubber. The reason why PBT is used is to keep the linear expansion coefficient thereof to be equivalent to that of the epoxy resin 8 or in a range of ±10% thereof as well as to increase the adherence property thereof with the epoxy resin 8 by means of the rubber contention. Specifically, the composition thereof is, for example, 55 weight % of PBT, 5 weight % of rubber, 20 weight % of glass fiber and 20 weight % of plate shaped elastomer.

Figure 9:
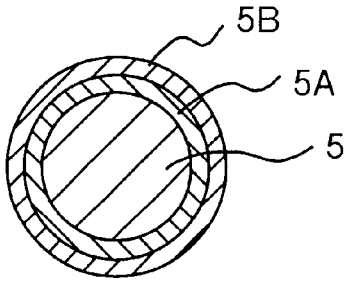
FIG. 9 a cross sectional view of the primary coil used in the above embodiment.

As schematically illustrated in FIG. 9, in addition to a cover coating 5A of an insulating body (for example, esterimide, amideimide and urethane) having a thickness of 10 μm~20 μm provided around a copper wire (diameter of 500 μm~800 μm) for the primary coil 5, another cover coating (an overcoating) 5B is further provided at the outside of the cover coating 5A which facilitates peeling off of the primary coil 5 from the insulation use resin (epoxy resin) 8 filled around the primary coil 5. The overcoating 5B is constituted by adding a few % of such as nylon, polyethylene and teflon which improves a slipping property into a material same as that constituting the insulating body 5A, and the thickness of the cover film is 1 μm~5 μm.

The reasons why positively applying on the primary coil 5 the overcoating 5B having a poor adhesiveness with the epoxy resin 8 as indicated above is to reduce the stress component σ1 caused inside the secondary coil bobbin 2 due to the thermal contraction difference (linear expansion coefficient difference) between the primary coil 5 and the secondary coil bobbin 2 among the entire stress σ caused inside the secondary coil bobbin 2 (to satisfy the above condition (1)).

Figure 4:
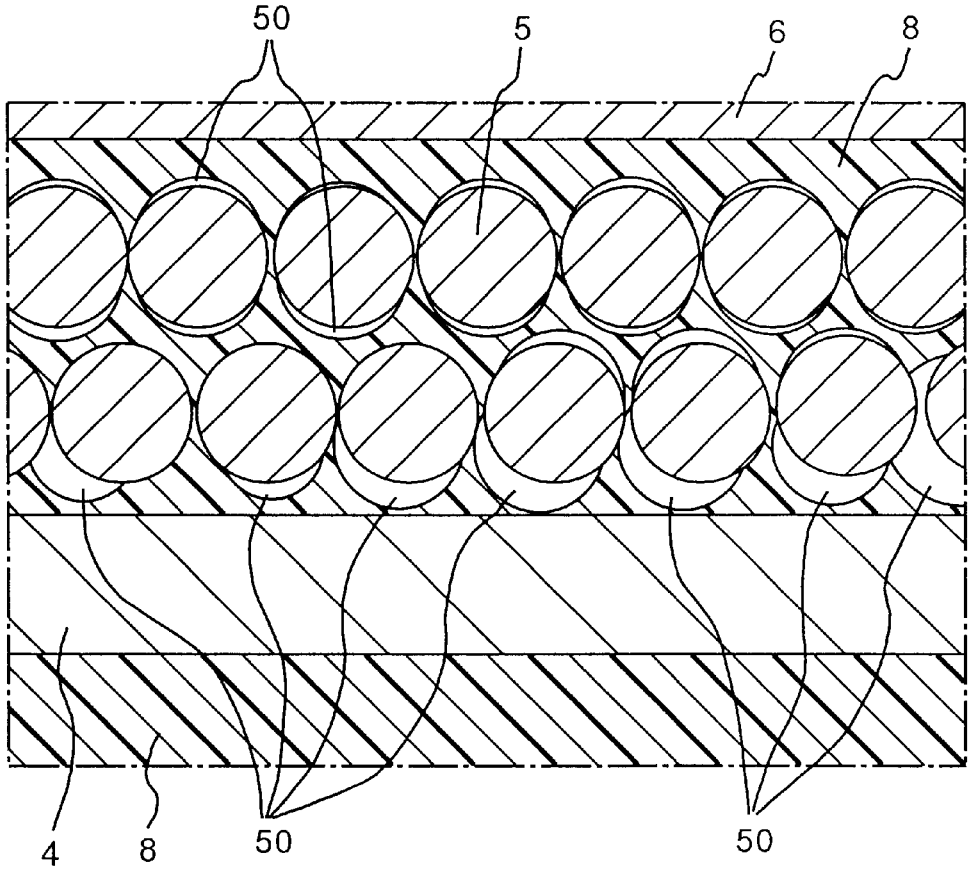
FIG. 4 an enlarged cross sectional view of portion C in FIG. 2.

Namely, because of the existence of the above overcoating 5B, a peeling off portion (gap) 50 is generated between the primary coil 5 and the epoxy resin 8 existing around the primary coil 5 as shown in FIG. 4, in that, the peeling off portions 50 co-exist with the epoxy resin 8 such as between the epoxy resin 8 filled between the primary coil bobbin 4 and the primary coil 5 and the primary coil 5, and between layers of the primary coil 5. Further, FIG. 4 is a cross sectional view enlarging portion C in FIG. 2 and which is prepared based on a microscopic tomogram (magnification of 30~40 times) taken from the portion corresponding to portion C.

As has been explained above, through inter-position of the gaps (peeling off portions) 50 such as between the primary coil bobbin 4 and the primary coil 5 and between the layers of the primary coil 5, the transmission passage of a tension force (the tension force due to the thermal expansion difference between the primary coil and the secondary coil bobbin) in the circumferential direction acting on the secondary coil bobbin 2 from the primary coil 5 can be interrupted. Accordingly, through the reduction of the stress component σ1 caused by the existence of the primary coil among the entire stress σ caused in the secondary coil bobbin, it is possible to reduce (relax) more than 20% of the entire stress σ. Further, through the inclusion of the inorganic filler of more than 20 weight % as has been mentioned above, the material quality of the secondary coil bobbin, in that linear expansion coefficient, of the denaturated PPE is improved and the internal stress (thermal stress) can be reduced, therefore, according to CAF analysis examples, performed by the present inventors the induced stress a in the secondary coil bobbin in the circumferential direction (the orthogonal direction with respect to the resin flowing direction during the bobbin molding, hereinbelow sometimes being referred to as θ direction)can be greatly reduced through the multiple effects with the stress relaxing action by the gaps 50 as indicated above.

Figure 12:
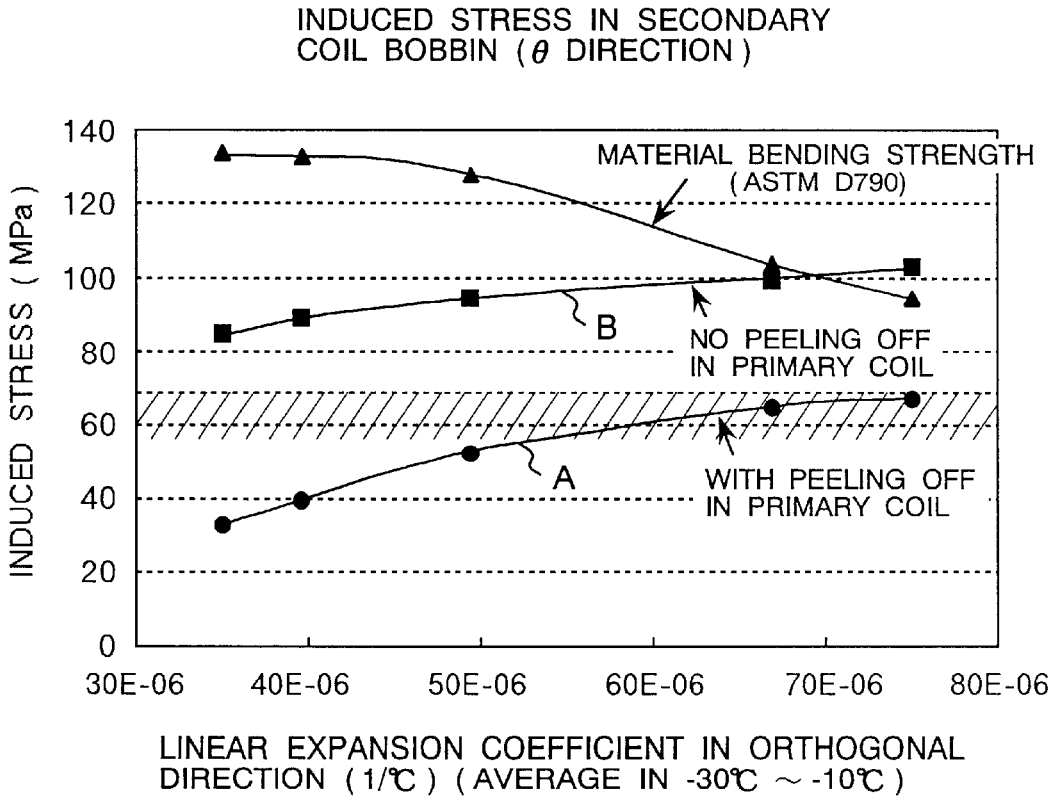
FIG. 12 is a diagram showing a relationship between expansion coefficient of the secondary coil bobbin in the circumferential direction (the orthogonal direction with respect to the resin flowing direction during the molding thereof) and induced stress in the secondary coil bobbin.

FIG. 12 shows a relationship between linear expansion coefficient of the secondary coil bobbin according to the present embodiment in the orthogonal direction with respect to the resin flowing direction (the bobbin axial direction) and induced stress (in θ direction) in the bobbin is shown.

The induced stress (thermal stress) in the secondary coil bobbin as shown in FIG. 12, in that the internal stress induced at temperature −40° C. in θ direction while assuming that the induced stress at the temperature 130° C. when the epoxy resin is hardened is zero, is determined in the following manner, in that by making use of a CAF analysis software, by preparing a three dimensional model of an ignition coil and by inputting material property values (linear expansion coefficient, Young's modulus and Poisson's ratio of the respective. Further, as an approximate value of the linear expansion coefficient in such material property values at the temperature −40° C., an average value $35\sim75\times10^{-6}$ of the secondary coil bobbin material at temperatures of −30° C.~−10° C. is used.

In FIG. 12, the solid line A corresponds to the present embodiment (in which the peeling off portions 50 are provided around the primary coil) and is determined in view of the secondary coil bobbin material exemplified in FIG. 13 (20 weight % of glass filler base as of FIG. 12 and including 0 weight %, 20 weight % or 30 weight % of mica) and by using the average linear expansion coefficient $35\sim75\times10^{-6}$ at a temperature range of −30° C.~−10° C. as an approximate value of the inner expansion coefficient of the secondary coil bobbin. More specifically, the CAF analysis was performed by making use of the five approximated linear expansion coefficients in θ direct ion of the secondary coil bobbin at temperature −40° C. in that about $40\times10^{-6}$ (strictly, $39.6\times10^{-6}$), about $50\times10^{-6}$ (strictly, $49.3\times10^{-6}$) and about $70\times10^{-6}$ strictly $66.8\times10^{-6}$), and as tolerances $35\times10^{-6}$ and $75\times10^{-6}$.

As the result of the analysis, it is determined that the averaged linear expansion coefficient of the secondary coil bobbin at a temperature approximating of −40° C. (−30° C.~−10° C.) is assumed as $35\sim75\times10^{-6}$ (the lowest value $35\times10^{-6}$ in the averaged value is based on the limitation of composition amount of the inorganic filler which permits molding of the secondary coil bobbin), the induced stress in the secondary coil bobbin can be reduced less than 70 MPa (which is an allowable upper limit of the internal stress (thermal stress) in the secondary coil bobbin and is determined as a target value by the present inventors).

Figure 14:
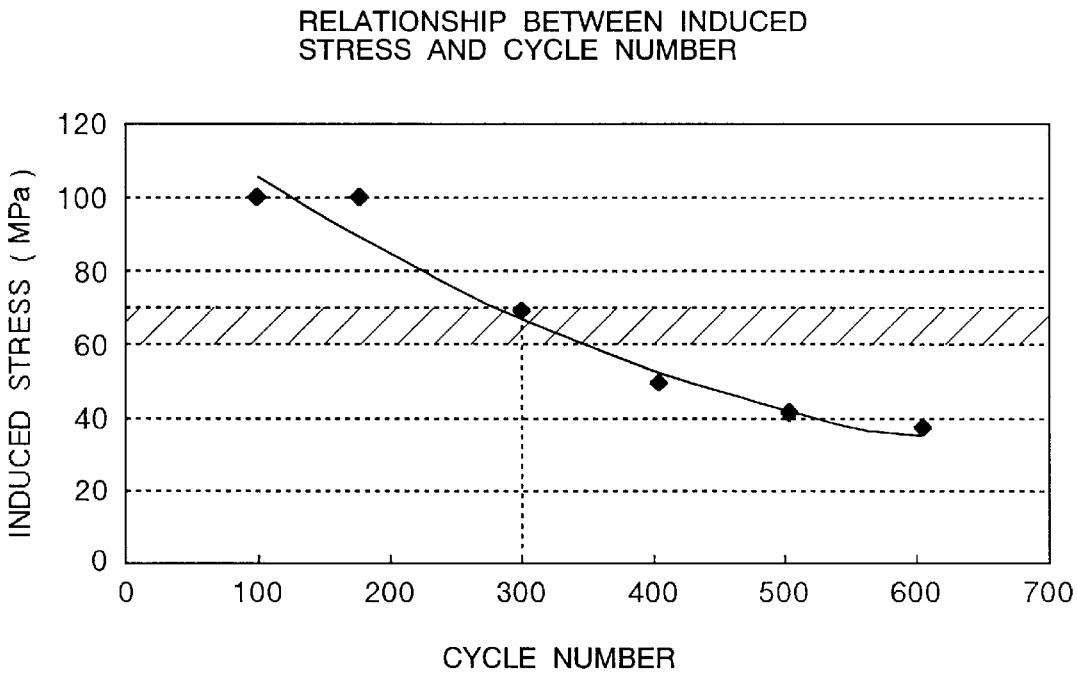
FIG. 14 is a diagram showing a relationship between induced stress in the secondary coil bobbin and heat cycle number.

The target value less than 70 MPa of the induced stress is based on the CAF analysis performed by the present inventors, and the ground of such numerical value is for passing a heat cycle test (a test of repeating temperature variation of 130° C.~−40° C. at 300 times) which sufficiently satisfies the durability of this sort of ignition coil for an internal combustion engine as shown in FIG. 14. FIG. 14 is a characteristic test diagram of the induced stress in the secondary coil bobbin 2 and number of heat cycles, the abscissa represents the number of heat cycles and the ordinate represents the induced stress, and the induced stress below 70 MPa shows that no crackings are caused in the secondary coil bobbin even when being subjected to the heat cycles more than 300 times.

Further, the solid line B in FIG. 12 is a comparative example showing an analysis result of the induced stress in a secondary coil bobbin for an ignition coil in which no peeling off portions 50 as referred to above are provided around the primary coil when the linear expansion coefficient thereof in θ direction is set likely as that shown in the solid line A, in this instance all of the induced stresses of the secondary coil bobbins in the circumferential direction showed more than 80 MPa.

Further, it was confirmed through experimental results performed by the present inventors that even if the above mentioned peeling off portion 50 is provided between the primary coil bobbin 4 and the primary coil 5 and between the layers of the primary coil 5, no electric field concentration between the primary coil 5 is caused because of a low potential (substantially at the ground potential) of the primary coil 5, in addition if the secondary coil 3, the insulation use resin 8 and the primary coil bobbin are closely bonded without gaps, the insulation between the primary coil and the secondary coil can be sufficiently ensured, moreover, a possible electric field concentration due to the line voltage of the secondary coil is prevented, thereby a possible generation of insulation breakdown can be prevented.

In particular, according to the present embodiment, since the PBT containing rubber is used for the primary coil bobbin, the adherence property thereof with the epoxy resin is increased, thereby, at the inner diameter side of the primary coil bobbin 4 a possible peeling off thereof from the epoxy resin 8 is surely prevented and a desirable insulation property is realized while maintaining an adherence property between the secondary coil, the epoxy resin 8 and the primary coil bobbin 4.

Further, for the primary coil bobbin 4 a thermoplastic resin such as PPS (polyphenylene sulfide) and denaturated PPE can be used.

For the coil casing 6 a thermoplastic resin such as PBT, PPS and denaturated PPE is used. At the outside surface of the coil casing 6 the side core 7 is mounted. The side core 7 constitutes a magnetic flux passage together with the center core 1, and is formed by deforming a thin silicon steel sheet or directional silicon steel sheet having a thickness of about 0.3 mm~0.5 mm into a tube shape.

Reference numeral 20 is an ignition circuit unit (ignitor) coupled onto the top portion of the coil casing 6, inside a unit casing 20*a* an electronic circuit (an ignition coil drive circuit 23) for driving the ignition coil is mounted and a connector portion 21 for connecting to an external portion is molded integrally together with the unit casing 20*a*.

Figure 7A:
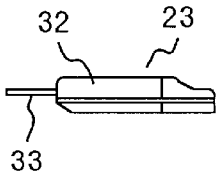
FIG. 7*a* is a front view showing a transfer-molded ignition coil drive circuit used in the above embodiment.
Figure 7B:
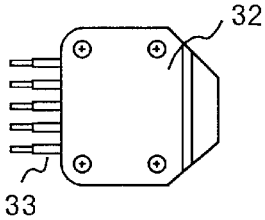
FIG. 7*b* is an upper plane view thereof and FIG. 7*c* is an upper plane view showing a mounting of the ignition coil drive circuit before performing the transfer-molding.
Figure 7C:
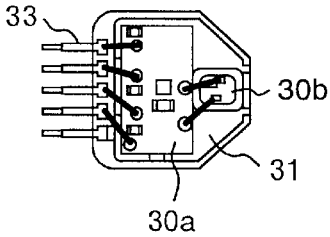

The ignition coil drive circuit 23 according to the present embodiment is transfer-molded finally, and FIG. 7*a* is a front view of the discrete product thereof, FIG. 7*b* is an upper view thereof and FIG. 7*c* is a view showing a state when an ignition coil drive circuit use hybrid IC 30*a* and a element (semiconductor chip) 30*b* are mounted on a base (substrate) 31 with terminals 33 before performing the transfer-molding. As illustrated in FIGS. 7*a*~7*c* after mounting the hybrid IC 30*a* and the power element 30*b* on the base 31, the transfer-mold 32 is applied.

Figure 6:
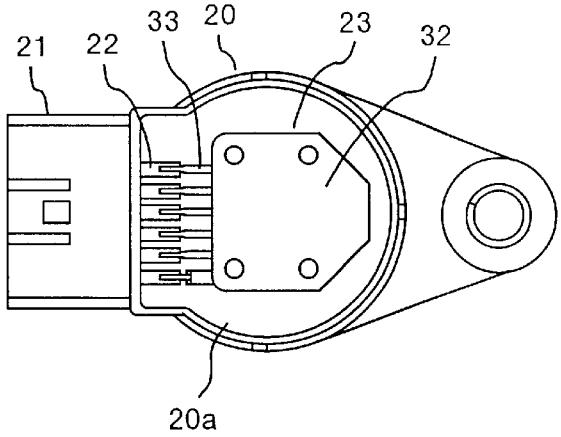
FIG. 6 is an upper plane view of an ignitor casing in the above embodiment.

FIG. 6 shows a state where the transfer-molded ignition coil drive circuit 23 is mounted within the unit casing 20*a* and after connecting the terminals 33 of the ignition coil drive circuit 23 to connector terminals 22 of the unit casing 20*a* at the time of mounting, the epoxy resin 8 is injected into the unit casing 20 and hardened. FIG. 1 shows a state where the epoxy resin 8 is filled in the unit casing 20*a* and transfer-molded ignition coil drive circuit 23 is illustrated in a perspective state. The ignition coil drive circuit 23 is buried in the epoxy resin 8.

In the present embodiment, circuit elements other than the power transistor in the ignition coil drive circuit 23 which are not suitable to be incorporated into a chip, for example a capacitor (not shown) for preventing noises is attached at the outside of the pencil coil. The noises preventing use capacitor is arranged between a power source line and ground both of which are not illustrated, and prevents noises generated in connection with the conduction control of the ignition coil.

Through use of such transfer-molded ignition coil drive circuit 23, the ignition coil drive circuit 23 can be formed into one chip IC which simplifies the production process, thereby, advantages such as cost reduction and input current decrease can be achieved.

Reference numeral 11 is a high voltage diode, reference numeral 12 is a leaf spring, reference numeral 13 is a high voltage terminal, reference numeral 14 is an ignition plug connection use spring and reference numeral 15 is an ignition plug connection use rubber boot. The high voltage diode 11 functions to prevent an earlier firing, when a high voltage generated at the secondary coil 3 is supplied to the ignition plug via the leaf spring 12, the high voltage terminal 13 and the spring 14.

The primary functions and advantages of the present embodiment are as follows.

(1) Even when the independent ignition type ignition coil which is fitted into a plug hole and is subjected to a severe temperature environment, an internal stress $\sigma$ (thermal stress) induced in the secondary coil bobbin can be lowered.

Therefore, according to the present embodiment, the internal stress $\sigma$ induced in the secondary coil bobbin is significantly reduced and the prevention of a cracking of the secondary coil bobbin (longitudinal direction cracking prevention) is surely achieved. In experiments, the secondary coil bobbin 2 was observed after subjecting the same repeatedly to a temperature variation of 130° C.~−40° C. in 300 times, and it was confirmed that no damages are caused in the secondary coil bobbin 2 and the soundness thereof is maintained.

(2) Further, even if the above gaps 50 are provided, the bonding property (adhesiveness) of the epoxy resin with the secondary coil bobbin 2 and the bonding property of the epoxy resin with the inside of the primary coil bobbin are desirable, a highly reliable pencil coil can be provided without deteriorating the insulation property thereof.

Figure 5:
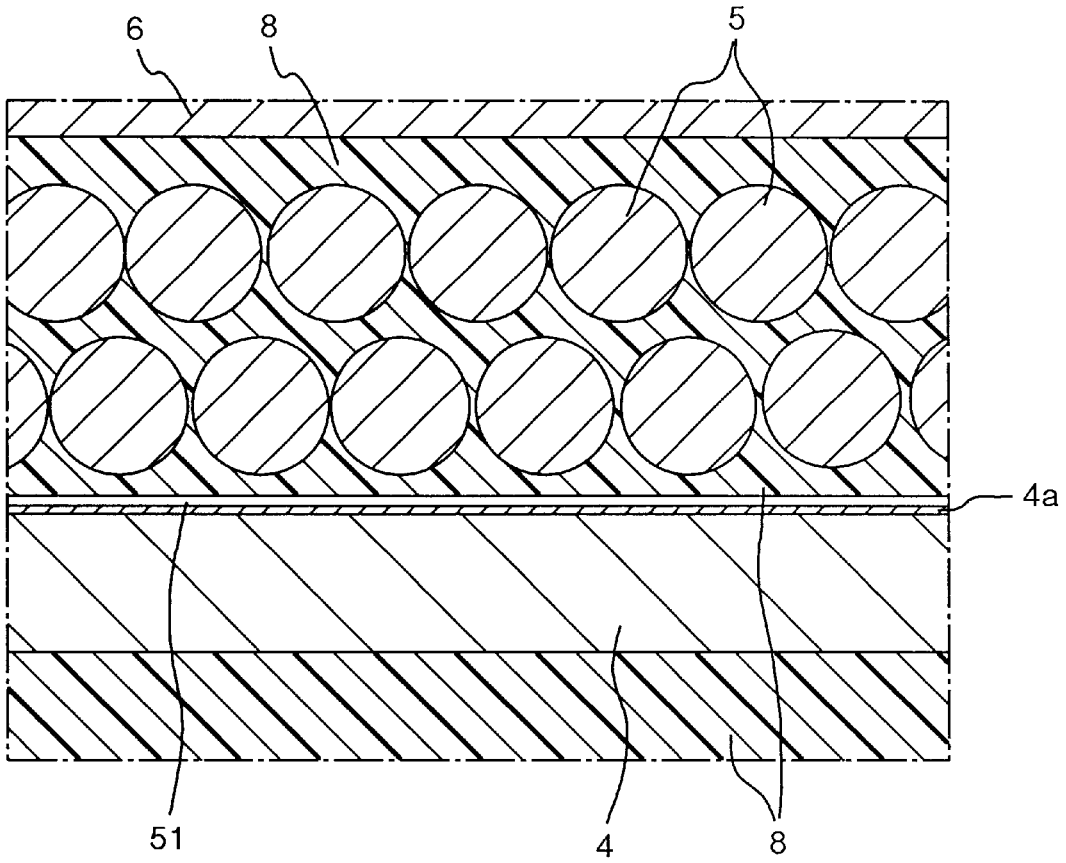
FIG. 5 is an enlarged cross sectional view of portion C representing another embodiment of the present invention.

Further, in the present embodiment, although the gaps 50 are formed between the primary coil 4 and the insulation use resin 8 around the primary coil 4, if other than the above, air gap portions (peeling off portions) 51 are formed between the insulation use resin (epoxy resin) 8 filled between the primary coil bobbin 4 and the primary coil 5 and the primary coil bobbin 5 as illustrated in FIG. 5, the same advantages (1) according to the present embodiment can be expected.

For example, in FIG. 5 embodiment, on one of the bobbin surfaces (outside surface of the bobbin) in the primary coil bobbin 4 on which the primary coil 5 is wound is applied an overcoating (cover film or cover coating) 4A which facilitates peeling off of the bobbin surface from the epoxy resin 8 contacting the bobbin surface, thereby the air gap portions are obtained. The material of the overcoating 4A is the like material as that of the already explained overcoating 5B. Further, in place of the above referred to overcoating a sheet of which adhesiveness with epoxy is weak can be adhered on the outside surface of the primary coil bobbin.

Further, both gaps 50 and 51 can be provided.

Figure 15:
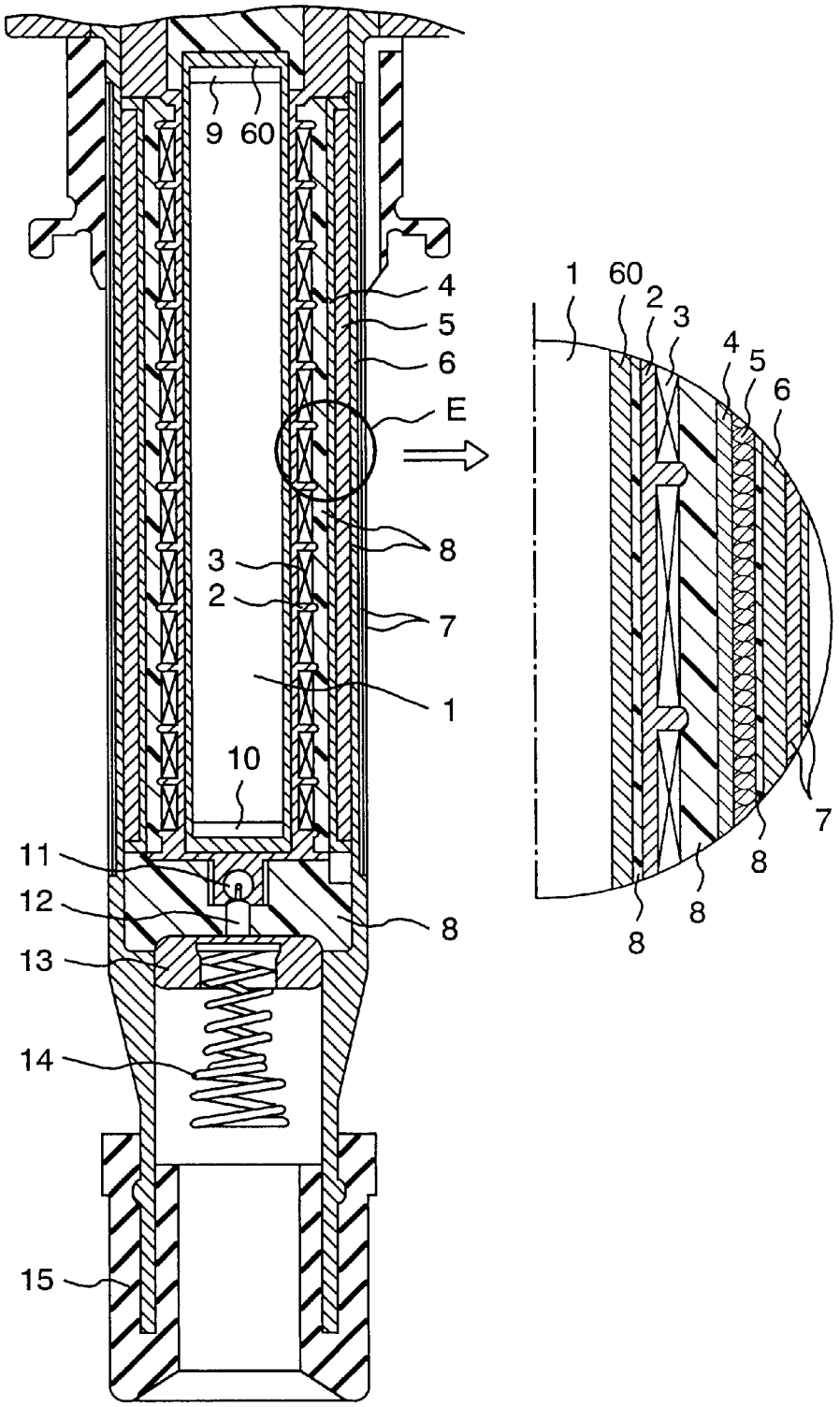
FIG. 15 is a vertical cross sectional view of an ignition coil for an internal combustion engine representing still another embodiment of the present invention and an enlarged cross sectional view of portion E.

FIG. 15 is a partially omitted cross sectional view showing another embodiment of the present invention, although not illustrated, the stress relaxing use gaps (peeling off portions) 50 and 51 like the above are provided between the primary coil bobbin 4 and the primary coil 5 and/or between layers of the primary coil 5, and further its constituting structure is the same as the previous embodiment except for the following points. The portions bearing the same reference numerals as those of the previous embodiment designate the same or common elements as those in the previous embodiment.

Namely, the different points from the previous embodiment are that the soft epoxy resin 17 is not injected between the center core 1 and the secondary coil bobbin 2, instead of that, the center core 1 is in advance covered by an insulation member 60 having an elasticity, for example silicon rubber, urethane and acrylic resin before being disposed inside the secondary coil bobbin 2 and after the covered center core 1 is disposed in the secondary coil bobbin 2, a hard epoxy resin 8 is filled between the center core 1 and the secondary coil bobbin 2.

According to the present embodiment, in addition to the advantages obtained by the first embodiment, the following functions and advantages are obtained. Through the absorption of the thermal impact between the center core 1 and the secondary coil bobbin 2 with the elastic member (the center core coating) 60, it is contributed to reduce the thermal stress $\sigma$ in the secondary coil bobbin 2. Moreover, in comparison with the injection and hardening works (injection and hardening in vacuum) of the soft epoxy resin in the narrow space between the secondary coil bobbin and the center core, the center core coating 60 can be performed only for the center core separate from the other constituting elements. Further, the injection and hardening of the usual hard epoxy resin between the center core and the secondary coil bobbin after inserting the coated center core 1 into the secondary coil bobbin can be performed easily because the viscosity of the hard epoxy resin is low in comparison with the soft epoxy resin, thereby, the work cost therefor can be reduced, in addition magnetic vibration generated from the center core can be effectively absorbed to achieve a noises reduction.

According to the present invention, in an independent ignition type ignition coil which is fitted in a plug hole and is subjected to a severe temperature environment, the thermal stress in the secondary coil bobbin due to the linear expansion coefficient differences between constituting members is relaxed, the crackings in the secondary coil bobbin is surely prevented, a soundness of an electric insulation performance thereof is held and a high quality and high reliability of the concerned type of ignition coil device is achieved.

What is claimed is:

1. An independent ignition type ignition coil for an internal combustion engine which is used after being inserted into a plug hole in the internal combustion engine and being directly coupled to a corresponding ignition plug and of which portion being inserted into the plug hole has an outer diameter of 18 mm–27 mm, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, wherein between he primary coil bobbin and the primary coil and/or between layers of the primary coil a gap portion which reduces a stress component caused inside the secondary coil bobbin due to thermal contraction difference of the primary coil and the secondary coil bobbin among thermal stress caused inside the secondary coil bobbin is coexisted with the insulation use resin, wherein on the primary coil a cover film or a cover coating is applied which facilitates peeling off of the insulation use resin filled around the primary coil from the primary coil, and a material of the cover film of the cover coating is an insulation material containing one of nylon polyethylene and teflon.

2. An ignition coil for an internal combustion engine according to claim 1, wherein a bobbin axial direction of the secondary coil bobbin corresponds to a resin flowing direction during molding of the resin, and a average linear expansion coefficient of the secondary coil bobbin in orthogonal direction with respect to thee resin flowing direction is $35\sim75\times10^{-6}$ at temperatures −30° C.~−10° C. according to a testing method conforming to ASTM D696.

3. An ignition coil for an internal combustion engine according to claim 1, wherein the primary coil bobbin is constituted by a polybutylene terphtahalate containing a rubber.

4. An ignition coil for an internal combustion engine according to claim 1, wherein the center core is coated with an insulation material having an elasticity before being disposed inside the secondary coil bobbin, and after the coated center core is disposed in the secondary coil bobbin a hard epoxy resin is filled between the center core and the secondary coil bobbin.

5. An independent ignition type ignition coil for an internal combustion engine which is used after being inserted into a plug hole in the internal combustion engine and being directly coupled to a corresponding ignition plug and of which portion being inserted into the plug hole has an outer diameter of 18 mm–27 mm, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, wherein the secondary coil bobbin is constituted by a denaturated PPE containing an inorganic filler material in an amount of not less than 20 weight % and between the primary coil bobbin and the primary coil and/or between layers of the primary coil a gap portion which reduces a stress component caused inside the secondary coil bobbin due to thermal contraction difference of the primary coil and the secondary coil bobbin among thermal stress caused inside the secondary coil bobbin is coexisted with the insulation use resin, wherein on the primary coil a cover film or a cover coating is applied which facilitates peeling off of the insulation use resin filled around the primary coil from the primary coil, and a material of the cover film of the cover coating is an insulation material containing one of nylon polyethylene and teflon.

6. An independent ignition type ignition coil for internal combustion engine which is used after being directly coupled to a corresponding ignition plug, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, wherein, between the primary coil bobbin and the primary coil and/or between layers of the primary coil, a gap portion which reduces a stress component causes inside the secondary coil bobbin due to thermal contraction difference of the primary coil and the secondary coil bobbin is coexisted with the insulation use resin, wherein the secondary coil bobbin is constituted by 45 weight % ~60 weight % of denaturated PPE, 15 weight %~25 weight % of glass fiber and 15 weight %~35 weight % of inorganic filler material in a non-fiber shape.

7. An ignition coil for an internal combustion engine according to claim 6, wherein the center core is coated with an insulation material having an elasticity before being disposed inside the secondary coil bobbin, and after the coated center core is disposed in the secondary coil bobbin a hard epoxy resin is filled between the center core and the secondary coil bobbin.

8. An ignition coil for an internal combustion engine according to claim 6, wherein the center core is coated with an insulation material having an elasticity before being disposed inside the secondary coil bobbin, and after the coated center core is disposed in the secondary coil bobbin a hard epoxy resin is filled between the center core and the secondary coil bobbin.

9. An independent ignition type ignition coil for an internal combustion engine which is used after being directly coupled to a corresponding ignition plug, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, wherein at least one between the primary coil bobbin and the insulation use resin filled between the primary coil bobbin and the primary coil, between the insulation use resin filled between the primary coil bobbin and the primary coil and the primary coil and between the primary coil and the insulation use resin filled between layers of the primary coil a peeling off portion is formed, wherein on the primary coil a cover film or a cover coating is applied which facilitates peeling off of the insulation use resin filled around the primary coil from the primary coil, and a material of the cover film of the cover coating is an insulation material containing one of nylon polyethylene and teflon.

10. An ignition coil for an internal combustion engine according to claim 9, wherein the primary coil bobbin is constituted by a polybutylene terphthalate containing a rubber.

11. An ignition coil for an internal combustion engine which is used after being directly coupled to a corresponding ignition plug, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, wherein at least one between the primary coil bobbin and the insulation use resin filled between the primary coil bobbin and the primary coil, between the insulation use resin filled between the primary coil bobbin and the primary coil and the primary coil and between the primary coil and the insulation use resin filled between layers of the primary coil a peeling off portion is formed, wherein the secondary coil bobbin is constituted by 45 weight %~60 weight % of denaturated PPE, 15 weight %~25 weight % of glass fiber and 15 weight %~35 weight of inorganic filler material in a non-fiber shape.

12. Am ignition coil for an internal combustion engine according to claim 11, wherein a bobbin axial direction of the secondary coil bobbin corresponds to a resin flowing direction during molding of the resin, and an average linear expansion coefficient of the secondary coil bobbin in orthogonal direction with respect to the resin flowing direction is $35\sim75\times10^{-6}$ at temperatures −30° C.~10° C. according to a testing method conforming to ASTM D696.

13. An ignition coil for an internal combustion engine according to claim 11, wherein the primary coil bobbin is constituted by a polybutylene terphthalate containing a rubber.

14. An ignition coil for an internal combustion engine according to claim 11, wherein the center core is coated with an insulation material having an elasticity before being disposed inside the secondary coil bobbin, and after the coated center core is disposed in the secondary coil bobbin a hard epoxy resin is filled between the center core and the secondary coil bobbin.

15. An ignition coil for an internal combustion engine according to claim 11, wherein the center core is coated with an insulation material having an elasticity before being disposed inside the secondary coil bobbin, and after the coated center core is disposed in the secondary coil bobbin a hard epoxy resin is filled between the center core and the secondary coil bobbin.

16. An independent ignition type ignition coil for an internal combustion engine which is used after being directly coupled to a corresponding ignition plug, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, wherein between the primary coil bobbin and the primary coil and/or between layers of the primary coil a gap portion which reduces a stress component cause inside the secondary coil bobbin due to thermal contraction difference of the primary coil and the secondary coil bobbin among thermal stress caused inside the secondary coil bobbin is coexisted with the insulation use resin on the primary coil a cover film or a cover coating is applied which facilitates peeling off of the insulation use resin filled around the primary coil from the primary coil, wherein a material of the cover film or the cover coating is an insulation material containing one of nylon, polyethylene and teflon.

17. An ignition coil for an internal combustion engine according to claim 16, wherein the primary coil bobbin is constituted by a polybutylene terphthalate containing a rubber.

18. An independent ignition type ignition coil for an internal combustion engine which is used after being directly coupled to a corresponding ignition plug, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, wherein on a side of bobbin surfaces of the primary coil bobbin on which the primary coil is wound a cover film or a cover coating which facilitates peeling off of the insulation use resin around the bobbin surface from the bobbin surface, wherein a material of the cover film or the cover coating is an insulation material containing one of nylon, polyethylene and teflon.

19. An ignition coil for an internal combustion engine according to claim 18, wherein a cover film or cover coating applied on a side of bobin surfaces of said primary coil on which the primary coil is wounded is a material having a small adhesion to the insulation use resin filled around said primary coil.

20. An ignition coil for an internal combustion engine according to claim 18, wherein the primary coil bobbin is constituted by a polybutylene terphthalate containing a rubber.

21. An ignition coil for an internal combustion engine according to claim 18, wherein the center core is coated with an insulation material having an elasticity before being disposed inside the secondary coil bobbin, and after the coated center core is disposed in the secondary coil bobbin a hard epoxy resin is filled between the center core and the secondary coil bobbin.

22. An ignition coil for an internal combustion engine which is used after being directly coupled to a corresponding ignition plug, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, on the primary coil a cover film or a cover coating is applied which facilitates peeling off of the insulation use resin filled around the primary coil from the primary coil, wherein a material of the cover film or the cover coating is an insulation material containing one of nylon, polyethylene and teflon.

23. An ignition coil for an internal combustion engine according to claim 22, wherein a cover film or a cover coating applied to said primary coil is a material having a small adhesion to the insulation use resin filled around said primary coil.

24. An ignition coil for an internal combustion engine according to claim 22, wherein the primary coil bobbin is constituted by a polybutylene terphthalate containing a rubber.

25. An independent ignition type ignition coil for an internal combustion engine which is used after being inserted into a plug hole in the internal combustion engine and being directly coupled to a corresponding ignition plug and of which portion being inserted into the plug hole has an outer diameter of 18 mm~27 mm, and which includes a center core, a secondary coil wound around a secondary coil bobbin and a primary coil wound around a primary coil bobbin arranged concentrically in a coil casing in this order from the inside of the coil casing and an insulation use resin filled between the constituting members in the coil casing, wherein between the primary coil bobbin and the primary coil and/or between layers of the primary coil a gap portion which reduces a stress component caused inside the secondary coil bobbin due to thermal contradiction difference of the primary coil and the secondary coil bobbin among thermal stress caused inside the secondary coil bobbin is coexisted with the insulation use resin, wherein the secondary coil bobbin is constituted by 45 weight %~60 weight % of denaturated PPE, 15 weight %~25 weight % of glass fiber and 15 weight %~35 weight % of inorganic filler material in a non-fiber shape.

26. An independent ignition type ignition coil for an internal combusione engine which is used after being directly coupled to a corresponding ignition plug, and which includes a center core, a secondary coil wound around a secondary coil bobbin and anprimary coil wound around a primary coil bobbin arranged concentrically in a coil casing in this order from the inside of the coil casing and an insulation use resin filled between the constituting members in the coil casing, wherein between the primary coil bobbin and the primary coil and/or between layers of the primary coil a gap portion which reduces a stress component caused inside the secondary coil bobbin due to thermal contraction difference of the primary coil and the secondary coil bobbin among thermal stress caused inside the secondary coil bobbin is coexisted with the insulation use resin, wherein at least one between the primary coil bobbin and the insulation use resin filled between the primary coil bobbin and the primary coil, between the insulation use resin filled between the primary coil bobbin and the primary coil and the primary coil and between the primary coil and the insulation use resin filled between layers of the primary coil a peeling off portion is formed, wherein the secondary coil bobbin is constituted by 45 weight %~60 weight % of denaturated PPE, 15 weight %~25 weight % of glass fiber and 15 weight %~35 weight % of inorganic filler material in a non-fiber shape.

* * * * *